United States Patent [19]

Ohba

[11] Patent Number: 4,462,506

[45] Date of Patent: Jul. 31, 1984

[54] BILL PACKET DISCHARGING APPARATUS

[75] Inventor: Hiroshi Ohba, Tokyo, Japan

[73] Assignee: Tokyo Shibaura Denki Kabushiki Kaisha, Kawasaki, Japan

[21] Appl. No.: 408,277

[22] Filed: Aug. 16, 1982

[30] Foreign Application Priority Data

Aug. 18, 1981 [JP] Japan ..... 56-129527

[51] Int. Cl.[3] ..... B65H 43/08

[52] U.S. Cl. ..... 221/13; 221/21; 271/35

[58] Field of Search ..... 209/534, 551; 235/379; 271/35, 3.1, 4, 9; 221/13, 21, 253; 414/43, 115

[56] References Cited

U.S. PATENT DOCUMENTS

| | | | |
|---|---|---|---|
| 3,008,565 | 11/1961 | Small | 221/13 X |
| 3,185,851 | 5/1965 | D'Emilio | 221/13 X |
| 4,017,004 | 4/1977 | Onoe et al. | 271/9 X |
| 4,066,253 | 1/1978 | Lundbald et al. | 271/9 X |
| 4,363,584 | 12/1982 | Kokubo | 271/9 X |
| 4,396,336 | 8/1983 | Malamood | 414/115 |

FOREIGN PATENT DOCUMENTS

| | | | |
|---|---|---|---|
| 23477 | 2/1981 | European Pat. Off. | 271/9 |

OTHER PUBLICATIONS

IBM Technical Disclosure Bulletin, vol. 18, No. 8, Jan. 1976, p. 2625.

*Primary Examiner*—Robert B. Reeves
*Assistant Examiner*—Edward M. Wacyra
*Attorney, Agent, or Firm*—Cushman, Darby & Cushman

[57] ABSTRACT

A bill packet discharging apparatus is disclosed, in which bill packets can be automatically supplied to an outlet from a bill packet storage section in which bill packets are accommodated in a stacked form. Bill packets can be successively fed out from the lowermost bill packet in the stack in the storage section to a transport path by a bill packet feeding mechanism. When the bill packet being fed out is a defective bill packet with the band thereof broken so that the bills are released, this state is detected optically, and the defective bill packet is automatically collected in a recovery section.

10 Claims, 10 Drawing Figures

BILL PACKET DISCHARGING APPARATUS

BACKGROUND OF THE INVENTION

This invention relates to a cash discharging apparatus and, more particularly, to a bill packet discharging apparatus for discharging packets of bills.

A cash discharging apparatus is used for an automatic cashing system for discharging packets of bills, individual bills or rolls of coins. With a hitherto used cash discharging apparatus, when a command for discharging a packet of bills of a given currency value is given, a rock mechanism in a bill packet box which contains bill packets of that currency value is released so that a desired number of bill packets can be taken out from the box by an operator, such as a bank clerk. With such an apparatus, the operator is liable to take out the wrong number of bill packets, increasing problems of efficiency and reliability. Also, with the above apparatus the bills must be taken out as a packet of bills. However, no means is provided for dealing with a packet of bills, when the band of the packet is broken freeing the bills. A discharging apparatus, which can discharge packets of bills perfectly and automatically, has therefore been desired.

SUMMARY OF THE INVENTION

An object of the invention is to provide a bill packet discharging apparatus, which can automatically discharge a given number of bill packets and can also recover defective bill packets.

According to the invention, there is provided a bill packet discharging apparatus, in which a given number of bill packets are successively taken out from a given bill packet box and supplied along a supply route to a bill packet outlet by a supply mechanism, while when a defective bill packet with a broken band is detected by a defective bill packet detector, the bill packet supply route is switched to a defective bill packet recovery route according to a signal from the detector.

DETAILED DESCRIPTION OF THE PREFERRED EMBODIMENT

Figure 1:
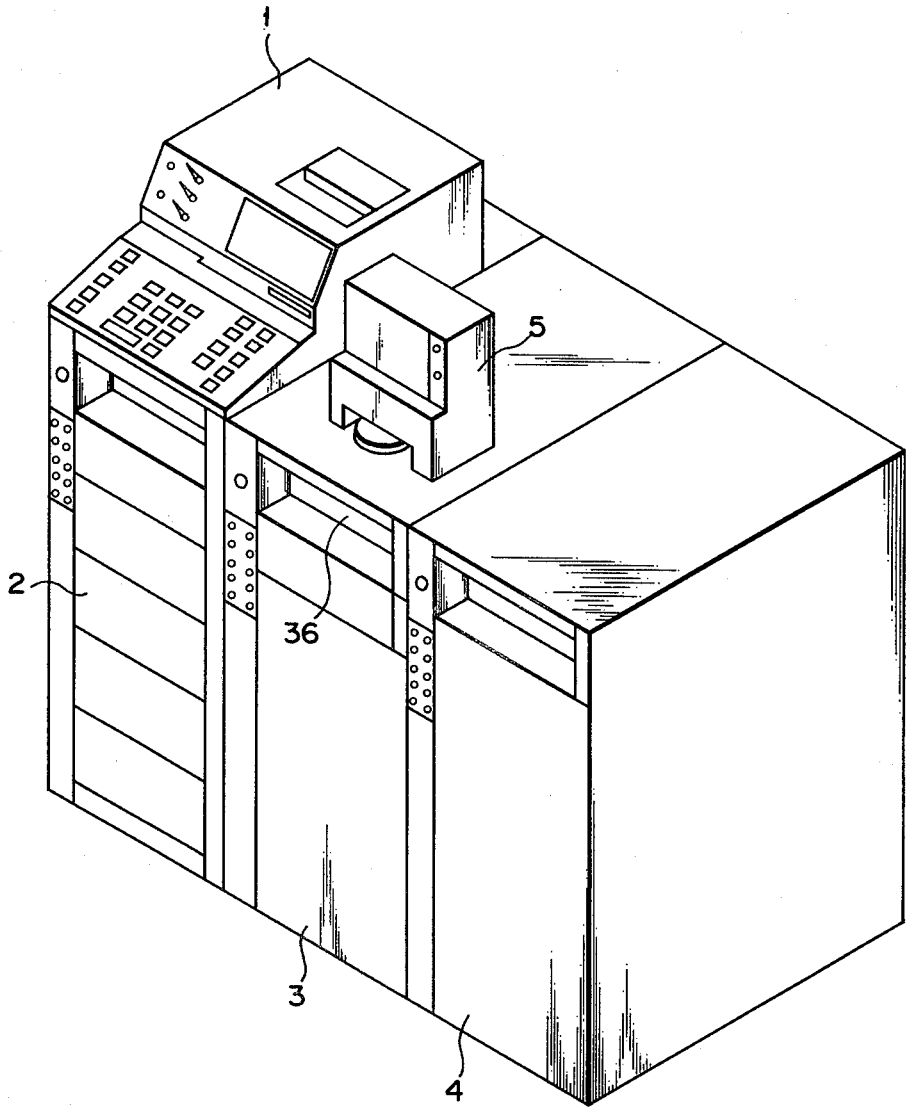
FIG. 1 is a perspective view showing an embodiment of the bill packet discharging apparatus according to the invention.
Figure 2:
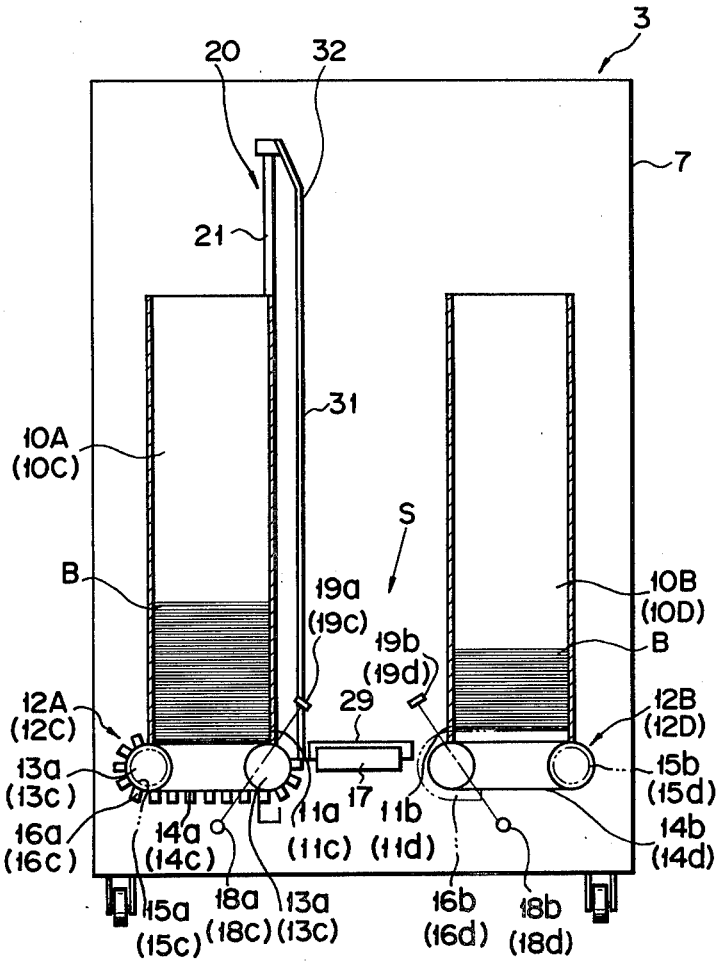
FIG. 2 is a schematic front view showing the internal construction of the bill packet discharging shown in FIG. 1.
Figure 3:
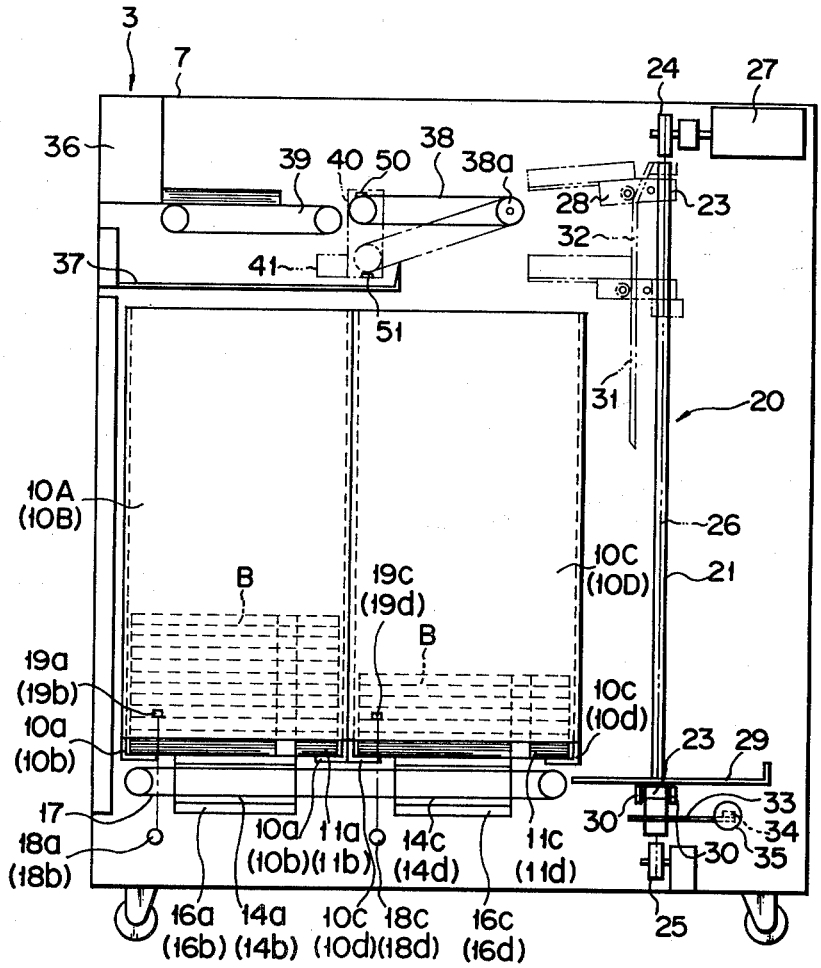
FIG. 3 is a schematic side view showing the internal construction of the bill packet discharging apparatus as shown in FIG. 1.
Figure 4:
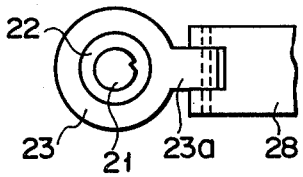
FIG. 4 is a fragmentary plan view showing a bill packet elevator shown in FIG. 3.

Referring to FIG. 1, an operating console 1 has a front operation panel having operation keys. A bill discharging apparatus 2 is provided under the operating console 1. A bill packet discharging apparatus 3 according to the invention is provided adjacent to the bill discharging apparatus 2. A coin roll discharging apparatus 4 is provided adjacent to the bill packet discharging apparatus 3. A coin discharging apparatus 5 is provided on the bill packet discharging apparatus 3. As shown in FIGS. 2 and 3, four bill packet boxes 10A to 10D with bill packets B are arranged in a casing 7 of the discharging apparatus 3 so that two bill packet boxes face the other two boxes respectively. In FIG. 2, the bill packet boxes 10A and 10C are disposed on the left side, and the boxes 10B and 10D are disposed on the right side. The bill packet boxes 10A and 10C and boxes 10B and 10D are spaced apart at a predetermined distance S from one another. In the boxes 10A to 10D, bill packets of different currency values are accommodated in respective stacks. The boxes 10A to 10D each have a rectangular plan view and disposed so that the widths of the accommodated bill packets face the front. As shown in FIG. 3, the bill packet boxes 10A to 10D each include a pair of regulating members **10*a* (10*b*, 10*c* and 10*d*) for holding the opposite widths of the lowermost packet of bills. The boxes 10A to 10D have respective openings 11*a* to 11*d* formed in the opposite length side walls adjacent to the bottom. The openings 11*a* to 11*d* have a height greater than the thickness of one bill packet but less than the thickness of two stacked bill packets. Thus, two bill packets are never fed out at one time. Also, if a bill packet being fed out is defective in that a broken band has released bills, these bills will remain without being fed out; these remaining bills will be fed out with the next bill packet in the next cycle. Bill packet feeders 12A to 12D are provided at the bottom of the respective boxes 10A to 10D. The bill packet feeders 12A to 12D comprise respective pairs of pulleys 13*a* to 13*d*, endless belts 14*a* to 14*d* passed round the pulleys 13*a* to 13*d* and motors 15*a* to 15*d* coupled to the pulleys 13*a* to 13*d*. The endless belts 14*a* to 14*d* are provided on the outer side with a plurality of projections 16*a* to 16*d*. A portion of the endless belts having a length slightly greater than the width of the bill packet is not provided with the projections 16*a* to 16*d*. The endless belts 14*a* to 14*d* are driven by the motors 13*a* and 13*d* toward the space S. The endless belts 14*a* to 14*d* have a width less than the distance between the associated pair regulating members 10*a* to 10*d***. They are disposed mid way between the associated pair regulating members so that they can smoothly run past the space between the pair regulating members.

Figure 5:
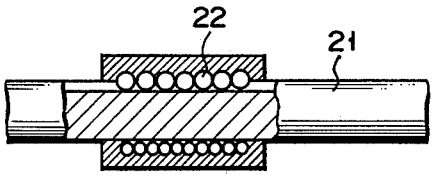
FIG. 5 is a view, partly in section, showing a bearing in a bill packet elevator shown in FIG. 4.
Figure 6:
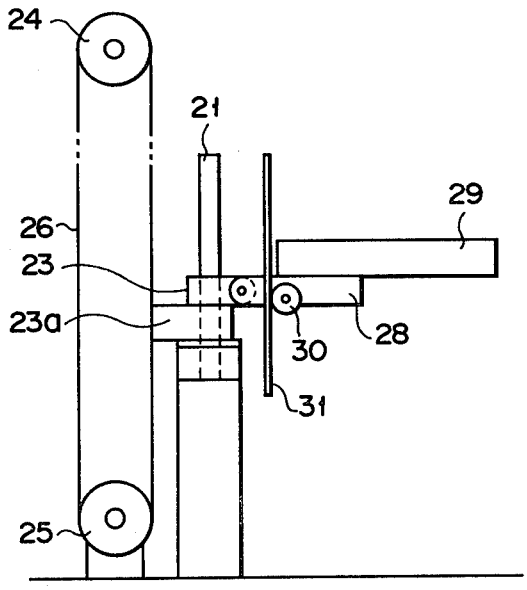
FIG. 6 is a side view showing a lower portion of the bill packet elevator.

In the space S mentioned above, a conveyor belt 17 is disposed to face the outlets of the bill packet boxes 10A to 10D. At the outlets of the boxes respective detectors are provided to detect defective packets such as packets with broken bands. The detectors are constructed by respective light emitters **18*a* to 18*d* and photosensors 19*a* to 19*d* facing one another. In the space S, there is also provided a bill packet elevator 20 for receiving a packet from the conveyor belt 17 and transporting the received packet upwards. The elevator 20 includes a vertical shaft 21 formed with a groove parallel with the axis. A bush 22 is fitted on the shaft 21, and a holder 23 is mounted on the bush 22. As shown in FIG. 5, a plurality of axial rows of balls are arranged in the bush 22. One of the ball rows is fitted in the groove of the shaft 21. Thus, the bush 22 can only move in the axial direction but cannot rotate with respect to the shaft 21. The holder 23 can be moved in the same way as the bush 22. As shown in FIG. 6, the holder 23 carries a slider 23***a* mounted thereon. The slider 23*a* is coupled to a portion of an endless wire or endless chain 26 which is passed round pulleys 24 and 25 disposed above and below the shaft 21 respectively. The pulley 24 is a drive pulley, to which a reversible motor 27 is coupled. Together with the forward or reverse rotation, the endless wire 26 is moved up or down the slider 23*a* together with the holder 23. The slider 23*a* rotates about the shaft 21. The holder 23 has an extension which is pivotally coupled to one end of a rest stay 28. The rest stay 28 is pivotable about its portion coupled to the holder extension. A stay 29 is secured to the other end portion of the rest stay 28. A packet of bills is transferred onto the rest 29. The rest stay 28 carries a pair of rollers 30 mounted on opposite sides. The guide rollers 30 are engaged in a lower guide rail 31 which is secured to a guide plate or bar 31 and extend along the same. An upper guide rail 32 has an upper inclined portion. When the rest stay 28 being raised together with the holder 23 reaches the inclined portion of the upper rail 32, it is tilted downward about the shaft coupled to the holder. When the rest stay 28 is tilted, the packet of bills on the rest 29 slips off the rest 29.

Figure 7:
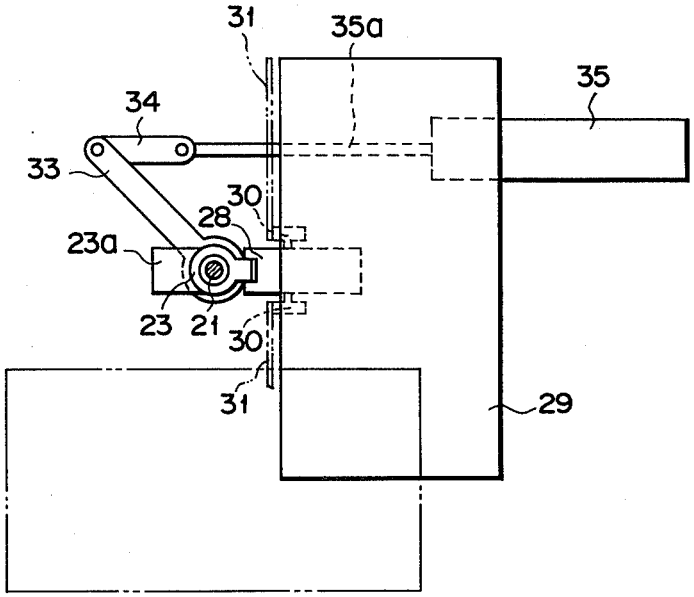
FIG. 7 is a side view showing a construction relevant to the bill packet elevator.

FIG. 7 is a top view of the bill packet elevator 20. A crank lever 33 is secured to a lower end portion of the rotatable shaft 21. The free end of the crank lever 33 is linked to a connecting rod 34, which is in turn coupled to a piston rod of an air cylinder 35. When the air cylinder 35 is operated, the piston rod 35*a* moves. This motion is converted by the crank lever 33 into a rotation of the shaft 21. With the rotation of the shaft 21 the holder 23 is rotated together with the bush 22 to rotate the rest 29 through 90 degrees while in a horizontal state.

With the bill packet elevator 20 having the above construction, a packet can be discharged with its one end, i.e., its width, first. Thus, bill packets can be readily taken out and operation efficiency is improved.

The bill packet discharging apparatus according to the invention also includes a conveyor 38, which can be switched between a position in which it leads to a conveyor 39 leading to a normal bill packet outlet 36 and a position in which it leads into a defective bill packet recovery box 37. The conveyor 38 can be pivotally moved between these positions about a fulcrum 38*a* by a link device 40 driven by a motor 41. A normal packet is transferred from the conveyor 38 to the conveyor 39 and discharged from the conveyor 39 to the outlet 36. A defective packet can be discharged from the conveyor 38, which is switched at this time to a downward tilted position, into the recovery box 37. With these two conveyors 38 and 39, the operation of taking out packets can be carried out with improved efficiency. Further, with the defective bill packet recovery box 37 provided below the normal bill packet outlet 36, it is easy to recover the released bills due to a broken band from the recovery box 37.

Figure 8:
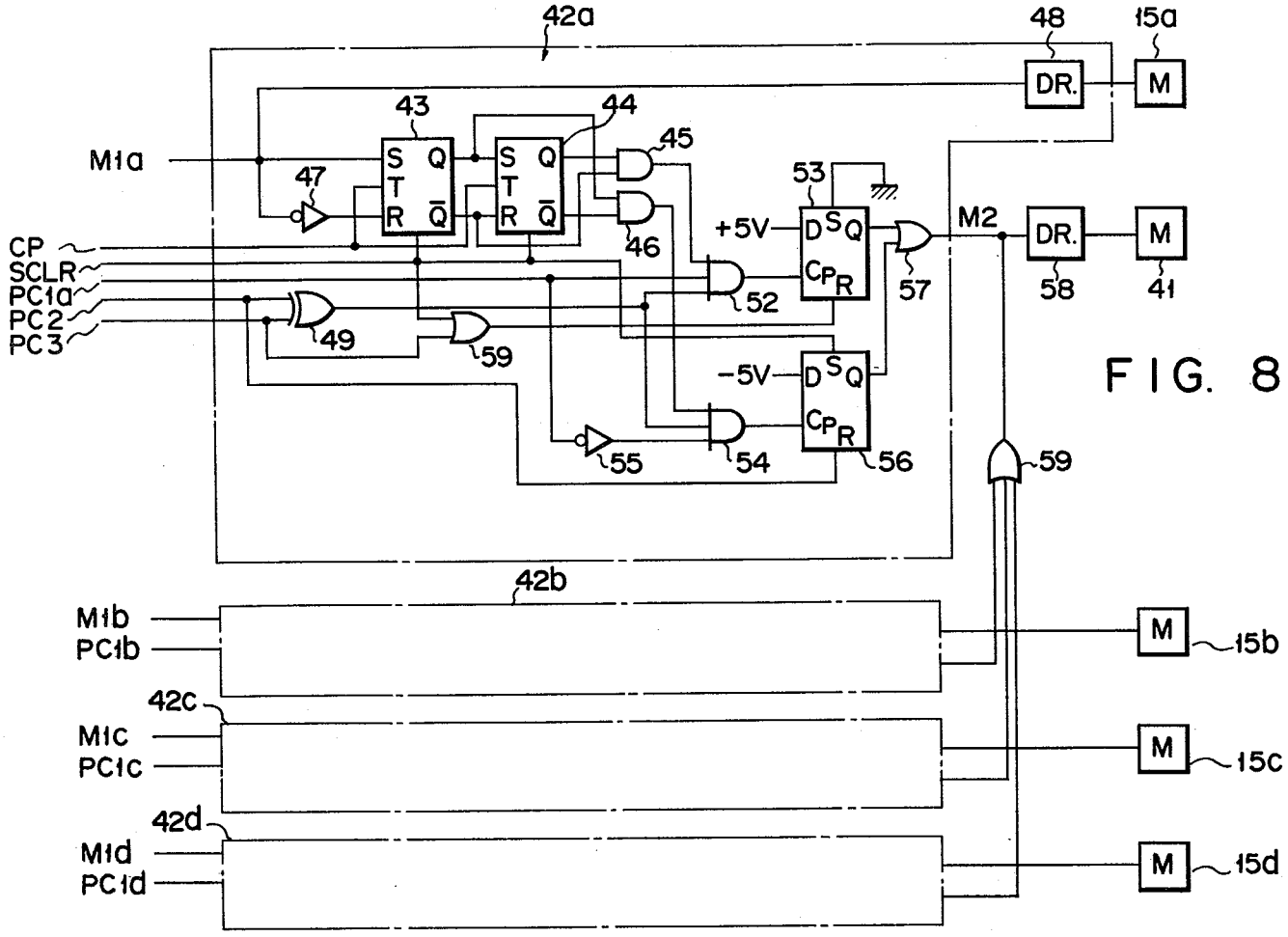
FIG. 8 is a schematic showing an electric system in the bill packet discharging apparatus shown in FIG. 1.

Now, a control section for controlling the switching of the conveyor 38 and driving of the packet feeders 12A to 12D will be described. FIG. 8 shows the control section. As shown in the Figure, four control circuits 42*a* to 42*d* are provided for the respective packet feeders 12A to 12D. Drive signals M1*a* to M1*d* are supplied to the respective control circuits 42*a* to 42*d*. The signal line, on which the signal M1*a* is transmitted, is connected to the set terminal S of a flip-flop 43 and is also connected through an inverter 47 to the reset terminal R of the same flip-flop. This signal line is further connected to a motor driver 48 which is in turn connected to a motor 15*a*. The output terminals Q and $\overline{Q}$ of the flip-flop 43 are connected to the respective set and reset terminals S and R of a flip-flop 44, and they are also connected to one input terminal of respective AND gates 45 and 46. The output terminals Q and $\overline{Q}$ of the flip-flop 44 are connected to the other input terminal of the respective AND gates 45 and 46. A clock pulse signal CP is supplied to a terminal T of each of the flip-flops 43 and 44. The output terminals of the AND gates 45 and 46 are connected to one input terminal of respective AND gates 52 and 54. A signal line, on which a photoelectric signal PC1*a* provided from the photosensor 19*a* is transmitted, is connected to another input terminal of the AND gate 52, and is also connected to another input terminal of the AND gate 54 through an inverter 55. Signal lines, on which signals PC2 and PC3 provided from respective upper and lower position detectors 50 and 51 shown in FIG. 3, are connected to respective input terminals of an exclusive OR gate (hereinafter referred to as EXOR gate) 49. The output terminal of the EXOR gate 49 is connected to a further input terminal of the AND gates 52 and 54. The output terminals of the AND gates 52 and 54 are connected to a clock pulse input terminal Cp of respective flip-flops 53 and 56. Signal lines, on which the signal PC3 and a start/clear signal SCLR are transmitted, are connected through an OR gate 59 to the reset terminal R of the flip-flop 53. The signal line of the signal SCLR is also connected to a clear terminal of each of the flip-flops 43 and 44 and also to the set terminal S of the flip-flop 56. The signal line of the signal PC2 is also connected to the reset terminal R of the flip-flop 56. The output terminals Q of the flip-flops 53 and 56 are connected through an OR gate 47 to a motor driver 58. The output terminal of the motor driver 58 is connected to the motor 41. OR gates 57 in the other control circuits 42*b* to 42*d* are connected through an OR gate 59 to the motor driver 58.

The operation of the bill packet discharging apparatus having the above construction will now be described in connection with the operation of the bill packet feeder 12A.

When the start/clear signal SCLR is generated from the operation console 1, the flip-flop 56 is set if the conveyor 38 is in its tilted or lower position shown in FIG. 3. If the conveyor 38 is in its non-tilted or upper position, the signal PC2 is provided from the upper position detector 50 so that the flip-flop 56 is held in the reset state. The flip-flop 56 provides the Q output in response to the output of the AND gate 54. When this Q output is supplied through the OR gate 57 to the driver 58, the driver 58 drives the motor 41. When the motor 41 is driven, the conveyor 38 is switched to its upper position.

When a drive signal M1*a* is subsequently provided from the operation console 1 to the control circuit 42*a*, the driver 48 drives the motor 15*a* in response to the signal M1*a*. At this time, the motor 15*a* causes one rotation of the endless belt 14*a* in the clockwise direction. In this rotation, one of the belts projections 16*a* is brought into engagement with one length side of the lowermost bill packet B in the stack in the bill packet box 10A and pushes out this packet B. Upon completion of one rotation of the endless belt 14*a*, the motor 15*a* is stopped, whereupon the flip-flop 43 is reset in response to the trailing edge of the drive signal M1*a*. As a result, a signal is provided from the AND gate 45. Since the pushed-out packet B at this time is a normal bill packet, the defective packet detector photosensor 19*a* provides an L (low) level signal PC1*a* so that the AND gate 52 remains closed. Thus, the flip-flop 53 remains reset to hold the conveyor 38 in its upper position.

The normal packet pushed out from the box 10A by the packet feeder 12A is transported on the conveyor 17 to be transferred onto the rest 29 of the elevator 20. As a result, the motor 27 is driven to raise the rest 29 along the shaft 21. At this time, the rest 29 is held in a horizontal position by the guide rollers 30 and guide plate 31. When the rest 29 reaches the upper inclined portion 32 of rails, the piston rod 35*a* in the air cylinder 35 is withdrawn to rotate the clank lever 33 in a clockwise direction in FIG. 7. The rotation of the crank lever 33 is transmitted to the shaft 21 to rotate the rest 29 through 90 degrees in a horizontal plane. At this time the guide plate 31 is rotated in unison with the shaft 21. Thus, the rest 29 can be rotated without interference from the plate 31. Further, with the rotation of the shaft 21 the endless wire 26 is not twisted because the slider 23*a* connecting the endless wire and holder 23 is rotatably fitted on the shaft 21. The rest 29, having been rotated through 90 degrees in a horizontal plane, is further raised along the guide plate 31 with the guide rollers 30 guided along the rails. When the guide rollers 30 reach the inclined portion of rails, the rest stay 28 is gradually tilted downward with its shaft coupled to the holder 23, thus causing downward tilting of the rest 29. In consequence, the packet B on the rest 29 is caused to slide off onto the conveyor 38. The packet B thus transferred to the conveyor 38 is transferred to the conveyor 39 to be discharged to the outlet 37.

Figure 9:
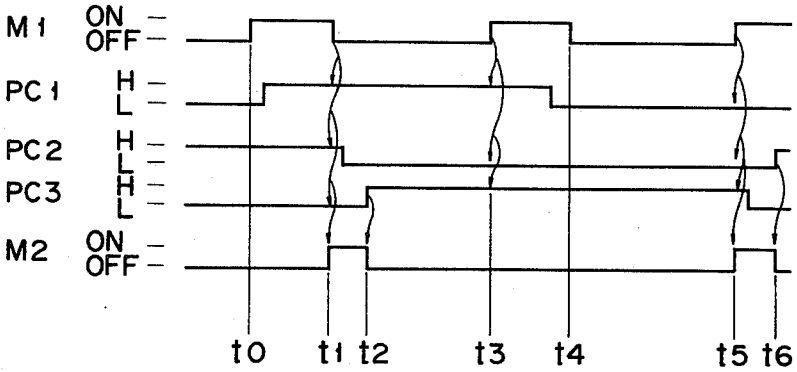
FIG. 9 is a time chart for explaining the operation of the electric system shown in FIG. 9.
Figure 10:
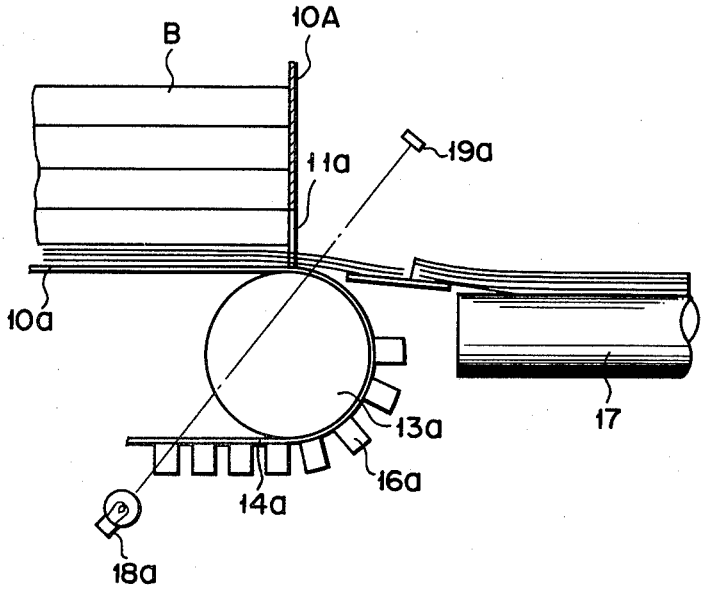
FIG. 10 is a side view showing a defective bill packet detector.

Now, the operation that takes place when the bill packet to be pushed out from the bill packet box 10A has a broken band releasing the bills in the bundle will be described with reference to the time chart of FIG. 9. When the drive signal M1*a* is supplied to the motor driver 48, the motor 15*a* is driven to cause operation of the packet feeder 12A. The packet B is pushed out by the feeder 12A in the period from t0 to t1. At the time point t1 at which the rotation of the motor 15*a* is completed, a signal corresponding to the leading edge of the drive signal M1*a* is supplied to the AND gate 52. At this time, the signal PC1*a* from the defective packet detector has been supplied to the AND gate 52. Since some released bills remain without being pushed out at this time, as shown in FIG. 10, the photosensor 19*a* of the detector provides a high level signal as the signal PC1*a*. That is, the AND gate 52 receives three high level signals, i.e., the signal of the AND gate 45, the signal PC1*a* and the signal of the EXOR gate 49. The AND gate 52 thus produces a high level output signal to set the flip-flop 53. The output signal Q of the flip-flop 53 is supplied through the OR gate 57 as a drive signal M2 to the motor driver 58. The motor driver 58 thus drives the motor 41 for the period from t1 till t2. During this period, the motor 41 drives the link device 40 to bring the conveyor 38 to the lower position. Meanwhile, the released bills having been pushed out onto the conveyor 17 are transferred onto the rest 29 of the elevator 20 and are raised to be caused to slide off onto the conveyor 38. The conveyor 38 this time conveys the released bills into the recovery box 37. The released bills cannot be completely recovered in a single cycle of the bill packet supplying operation. This is because the height of the projections 16*a* of the endless belt 14*a* is less than the height or thickness of one packet of bills. Some of the released bills corresponding to the difference between the height of the projections 16*a* and the height of one packet of bills, therefore, remains in the bill packet box 10A when the projection 16*a* pushes out the defective packet. Some of the remaining bills slightly project from the outlet 11*a* of the box 10A to block light from the light emitter 18*a*. When the next drive signal M1*a* is supplied to the control circuit 42*a* at time point t3 in this state, the motor 15*a* is driven again to cause another rotation of the endless belt 14*a*. The leading projection 16*a* is brought into engagement with the packet on the remaining released bills and pushes it together with the remaining bills. At this time, the AND gate 46 provides a high level signal. However, since the photosensor 19*a* is providing the high level signal PC1*a* so that the inverter 55 inverting this signal PC1*a* is providing the inverted signal to the AND gate 54, the flip-flop 56 is not set. Thus, the conveyor 38 is held in its lower position. When the remaining bills have been pushed out together with the next packet onto the conveyor 17 with the completion of one rotation of the endless belt 14*a*, the signal PC1*a* goes to a low level. However, before this time, i.e., at the time point t4, the drive signal M1*a* has gone to the low level. Thus, with the change of the signal PC1*a* to the low level, the output signal of the AND gate 46 goes to the low level, so that the flip-flop 56 is kept reset. The remaining bills and the next packet are brought up by the elevator 20 and caused to slide off onto the conveyor 38. The conveyor 38 conveys the remaining released bills together with the next packet into the recovery box 37. It will be seen that the defective packet of released bills can be completely collected in the recovery box 37 in two cycles of the bill packet supplying operation.

When a further drive signal M1*a* is supplied to the control circuit 42*a* at a subsequent time point t5, the output signal of the photosensor 19*a* has already gone to the low level. Thus the flip-flop 56 is set at this time, causing the motor 41 to be driven to switch the conveyor 38 to the upper position. Thereafter, the same operation as described earlier in connection with the operation of discharging a normal packet of bills can take place.

As has been described in the foregoing, according to the invention it is possible to provide a bill packet discharging apparatus, in which defectively bound bill packets can be automatically recovered when a given number of packets are automatically discharged, thus permitting improvement in the efficiency and reliability of the operation of handling bill packets.

What is claimed is:

1. A bill packet discharging apparatus comprising:

bill packet feeder means provided in the proximity of bill packet storage means accommodating a number of bill packets stored in a stack, each of said bill packets comprising a plurality of single sheets held together by a band, for automatically feeding out packets one after another to a transport path;

transport means provided on said transport path for transporting a bill packet fed out by said bill packet feeding means;

bill packet state detecting means for detecting in said transport path the state of a bill packet fed out by said bill packet feeding means;

switching means for switching the direction of said transport path to one of a direction leading to a discharging section and a direction leading to a recovery section according to a bill packet state signal provided from said bill packet state detecting means; and second transport means controlled by said switching means to switch the transport path direction to the direction leading to said discharging section to transport a transferred bill packet to said discharging section.

2. The bill packet discharging apparatus according to claim 1, wherein said switching means switches said transport path direction to the direction leading to said discharging section when said bill packet state detecting means produces a normal bill packet state signal and switches said transport path direction to the direction leading to said recovery section when said bill packet state detecting means produces a defective bill packet state signal.

3. The bill packet discharging apparatus according to claim 1 or 2, wherein when said bill packet state detecting means produces a defective bill packet state signal, said switching means causes at least two successive cycles of leading a bill packet transported on said first transport means to said recovery section.

4. The bill packet discharging apparatus according to claim 1 or 2, wherein said first transport means includes means for causing a bill packet fed out by said bill packet feeder means to be transported to one of said discharging section and said recovery section with one end of the bill packet in the longitudinal direction thereof as a leading end.

5. The bill packet discharging apparatus according to claim 1, wherein said bill packet feeder means includes means adapted to be brought into engagement with the lowermost one of said bill packets stacked on the bottom of said bill packet storage means for feeding out said lowermost bill packet.

6. The bill packet discharging apparatus according to claim 5, wherein said bill packet storage means includes a bill packet storage box having an opening formed adjacent to its bottom and having a height less than the thickness of two bill packets and greater than the thickness of one bill packet.

7. The bill packet discharging apparatus according to claim 5 or 6, wherein said bill packet feeder means includes an endless belt driven in the feed direction out of a bill packet storage means and engagement means including at least one projection mounted on said endless belt and having a height less than the thickness of one bill packet.

8. The bill packet discharging apparatus according to claim 5 or 6, wherein said first transport means includes conveyor means for transporting a bill packet fed out by said bill packet feeding means, elevator means for upwardly conveying the bill packet having been conveyed by said conveyor means and means for re-orientating the bill packet having been conveyed by said elevator means to an orientation in which one end of the bill packet in the longitudinal direction thereof faces the front of said apparatus.

9. The bill packet discharging apparatus according to claim 1, 2 or 5, wherein said discharging section is provided above said recovery section and said second transport means includes means driven by said switching means to an upper position leading to said discharging section for supplying the bill packet to said discharging section and to a lower position leading to said recovery section for supplying the bill packet to said recovery section.

10. The bill packet discharging apparatus according to claim 1, 2 or 5, wherein said bill packet state detecting means includes a photosensor provided at the outlet of said bill packet storage box for optically detecting the state of a bill packet being fed out.

* * * * *